US007048773B2

(12) United States Patent
Riedel et al.

(10) Patent No.: US 7,048,773 B2
(45) Date of Patent: May 23, 2006

(54) UNIVERSAL VACUUM FILTER CARTRIDGE

(76) Inventors: Steve D. Riedel, 9299 Talus Cir., Eden Prairie, MN (US) 55347; Steve Zeilinger, 7690 Barbara Ave. E., Inver Grove Heights, MN (US) 55077

( * ) Notice: Subject to any disclaimer, the term of this patent is extended or adjusted under 35 U.S.C. 154(b) by 157 days.

(21) Appl. No.: 10/633,859

(22) Filed: Aug. 4, 2003

(65) Prior Publication Data

US 2005/0028501 A1 Feb. 10, 2005

(51) Int. Cl.
*B01D 46/02* (2006.01)
*B01D 35/30* (2006.01)

(52) U.S. Cl. ..... 55/498; 55/385.1; 55/486; 55/487; 55/497; 55/503; 55/510; 55/521; 55/529; 55/DIG. 3; 15/347

(58) Field of Classification Search ..... 55/385.1, 55/486, 487, 495, 497, 498, 503, 516, 521, 55/529, DIG. 3; 15/347
See application file for complete search history.

(56) References Cited

U.S. PATENT DOCUMENTS 4,390,354 A * 6/1983 Witchell ..... 55/521
4,613,348 A * 9/1986 Natale ..... 55/DIG. 3
4,745,654 A * 5/1988 Yamamoto et al. ..... 15/347
4,989,292 A * 2/1991 Hwang ..... 15/347
4,995,891 A * 2/1991 Jaynes ..... 55/510
5,417,729 A * 5/1995 Greenleaf, Sr. ..... 55/503
5,489,352 A * 2/1996 Spearman ..... 55/521
6,171,375 B1 * 1/2001 Howie ..... 55/DIG. 3
6,179,903 B1 * 1/2001 Muller ..... 55/486
6,436,160 B1 * 8/2002 Stephens et al. ..... 55/DIG. 3
6,610,116 B1 * 8/2003 Avery ..... 55/503
2004/0206238 A1 * 10/2004 Allgeier ..... 15/347

* cited by examiner

*Primary Examiner*—Jason M. Greene

(57) ABSTRACT

A filter cartridge assembly for a vacuum cleaner that includes a main housing having an inlet and an outlet. The filter cartridge fits in a chamber where a motor and bell housing provides a vacuum on the outlet of the filter cartridge thus drawing air from the inlet to the outlet, and at least a first filter is arranged between the inlet and the outlet for filtering the air. The air must pass through one or more filter layers before exiting to the motor and bell housing. The described filter cartridge functions within the body of several vacuum cleaning machines.

13 Claims, 4 Drawing Sheets

UNIVERSAL VACUUM FILTER CARTRIDGE

I. BACKGROUND OF THE INVENTION

A. Field of the Invention

The invention generally relates to a replaceable, high efficiency vacuum filter cartridge which is designed to function in many brands of portable vacuum cleaning machines.

B. Description of Prior Art

Portable vacuum cleaners are used within homes, industry and medical facilities among others. There are many manufacturers of portable vacuum cleaning machines, each with their own replaceable filter cartridge. This requires a site using several brands of vacuum cleaning machines to also stockpile many replacement filter cartridges. There exists a need for a more universal filter cartridge which would fit conveniently into many brands of vacuum cleaning machines.

This invention resolves the need for universality of vacuum filter cartridges by designing a cartridge specifically to fit into many machines while maintaining High Efficiency Particulate Air (HEPA) filtration and Ultra-Low Penetration Air (ULPA) quality.

II. SUMMARY OF THE INVENTION

More specifically, this invention relates to a vacuum cleaner filter cartridge having primary, secondary and tertiary filters, and to an improved filter cartridge holding said filter set which is designed for use in many vacuum cleaning machines.

This invention provides a replaceable vacuum filter cartridge with dimensions allowing universality of use in many vacuum cleaning machines. Said cartridge provides very high efficiency removal of fine particulates from 0.3 microns to 0.12 micron air filtration. The cartridge fits in at least three different brands of vacuum cleaning machines and as many as 10 brands.

The filter cartridge described can be built of with several options of filter efficiencies from Standard (0.5 micron), HEPA (99.97% efficient at 0.5 micron) and ULPA (99.999% efficient at 0.12 micron) filtration.

III. DRAWINGS

A. BRIEF DESCRIPTION OF THE DRAWINGS

B. DETAILED DESCRIPTION OF THE DRAWINGS

Figure 3:
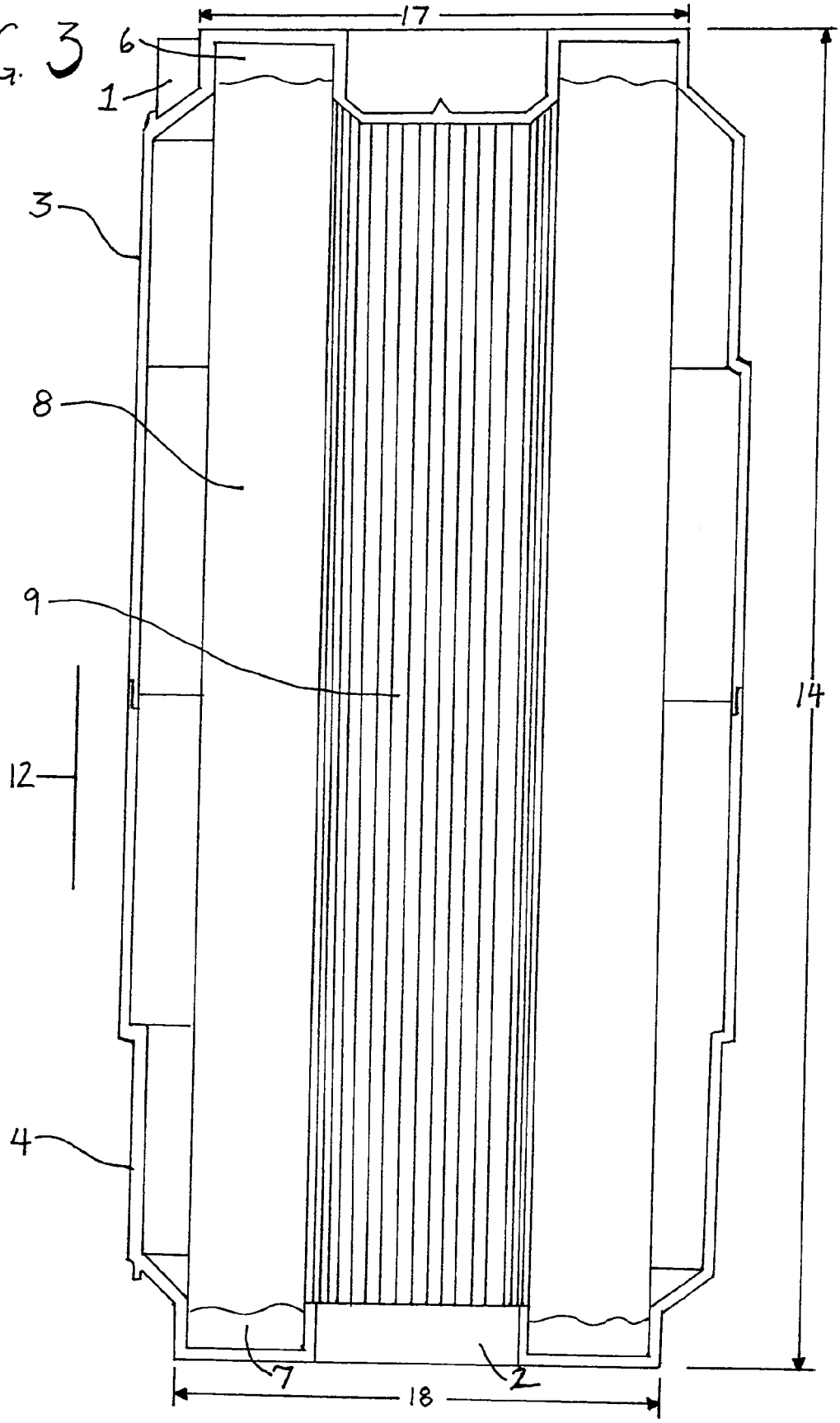
FIG. 3 illustrates the invention cartridge in longitudinal cross section.
Figure 4:
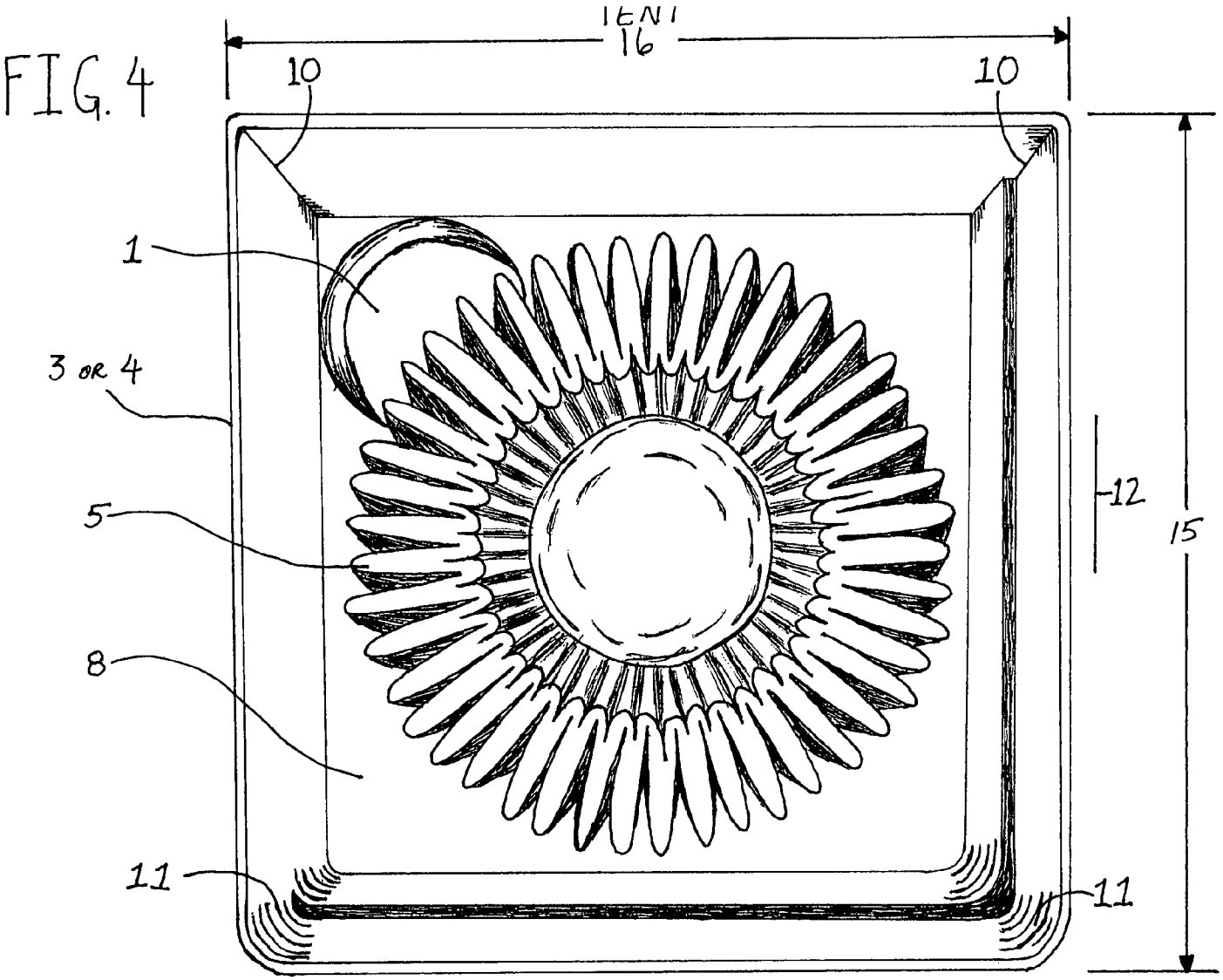
FIG. 4 illustrates the invention cartridge in lateral cross section.

FIG. 3 and FIG. 4 illustrates the invention cartridge in design detail. The air to be cleaned is drawn into the inlet (1) by a vacuum at the outlet (2) and collects within the outer chamber (8) of the cartridge body shell (12). The air then passes through a fan-folded filter media set (5) comprising of from one to five layers of filter material. After passing through the folded filter (5), the air collects in a central channel (9) running parallel to the length of the cartridge body (12). The cartridge body (12) is composed of two sections; The inlet section (3) and the outlet section (4). The fan-folded filter (5) is secured and sealed to both of the cartridge body segments at (6) and (7) using adhesives or hot-melt technology. The segments are sealed together using any one of many adhesion methods at (13) including adhesive tape, adhesives, hot-melt adhesives or ultrasonic welding.

FIG. 4 illustrates the outside shape of the two segments of the cartridge body (12). Adjacent longitudinal radii (11) and adjacent longitudinal radii (10) are critical dimensions as well as the three spatial dimensions: outside length (14) in FIG. 3 and outside width dimension (15) and (16) in FIG. 4. The body segments which receive the fan-fold filter are also critical dimension: the inlet end (17) and the outlet end (18) in FIG. 3. All critical dimensions are also listed in Table I below.

IV. DESCRIPTION OF THE PREFERRED EMBODIMENT

Figure 1:
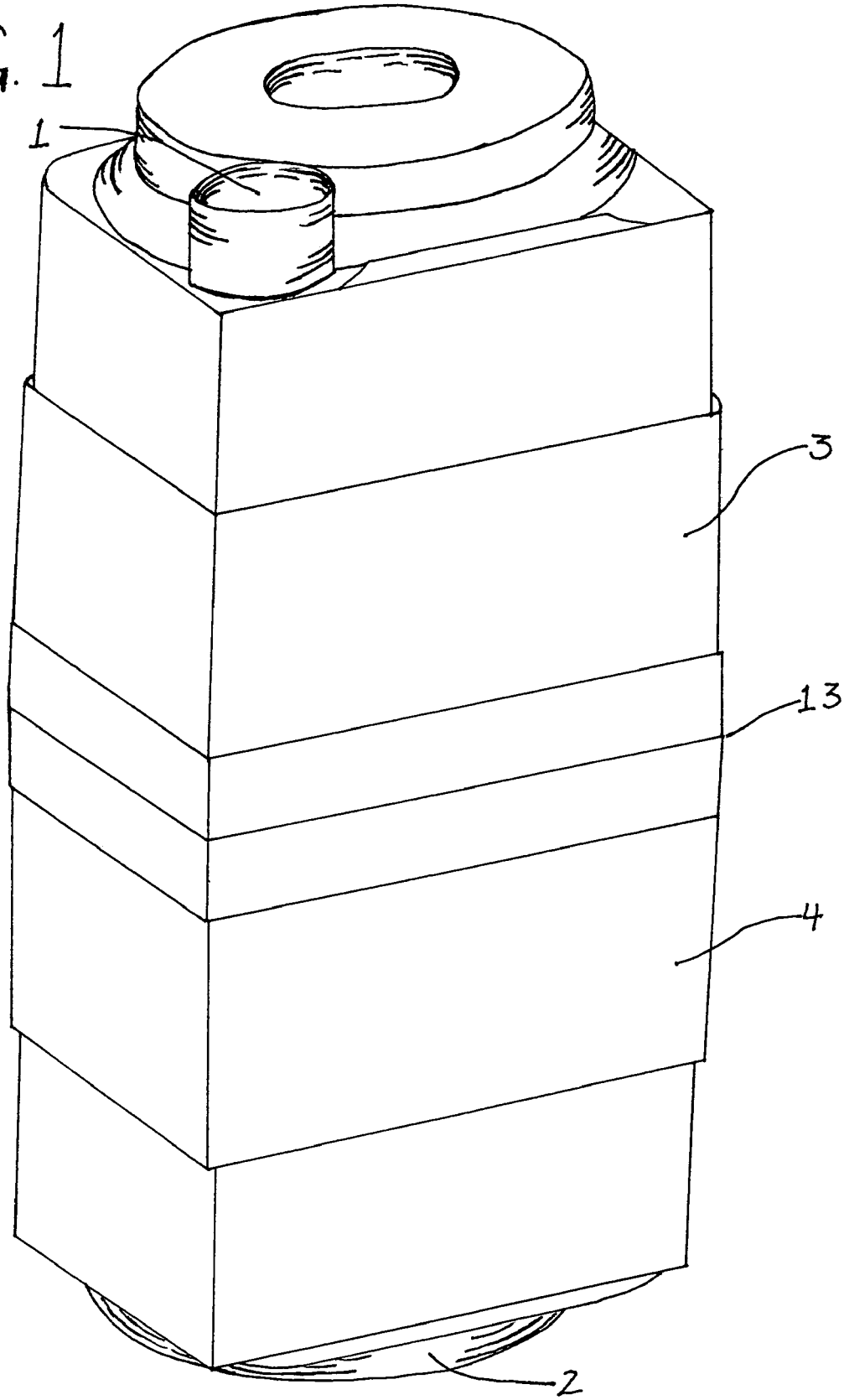
FIG. 1 illustrates the perspective view of the invention cartridge.

The vacuum cleaner filter cartridge referred to in FIG. 1 and shown in detail in FIGS. 3 and 4 are manufactured with precise outside dimensions. The air outlet (2) corresponds to the vacuum source of the vacuum cleaning machine. The outside dimensions and shape allows for universality of fit within the body of at least three manufacture's machines selected from the group:

A) Atrix International, Inc.: OMEGA®, OMEGA® Supreme, ULTIVAC®, ULTIVAC® DLX, MENDA® Vac B) The 3M field Corporation: service vacuum cleaners models 497AJ, 497AB, 497AJH, 497ABD, 497AJK, 497AJM C) LaserVac, an Eltrex Company: The SHARK 9000 SERIES II®.

Figure 2:
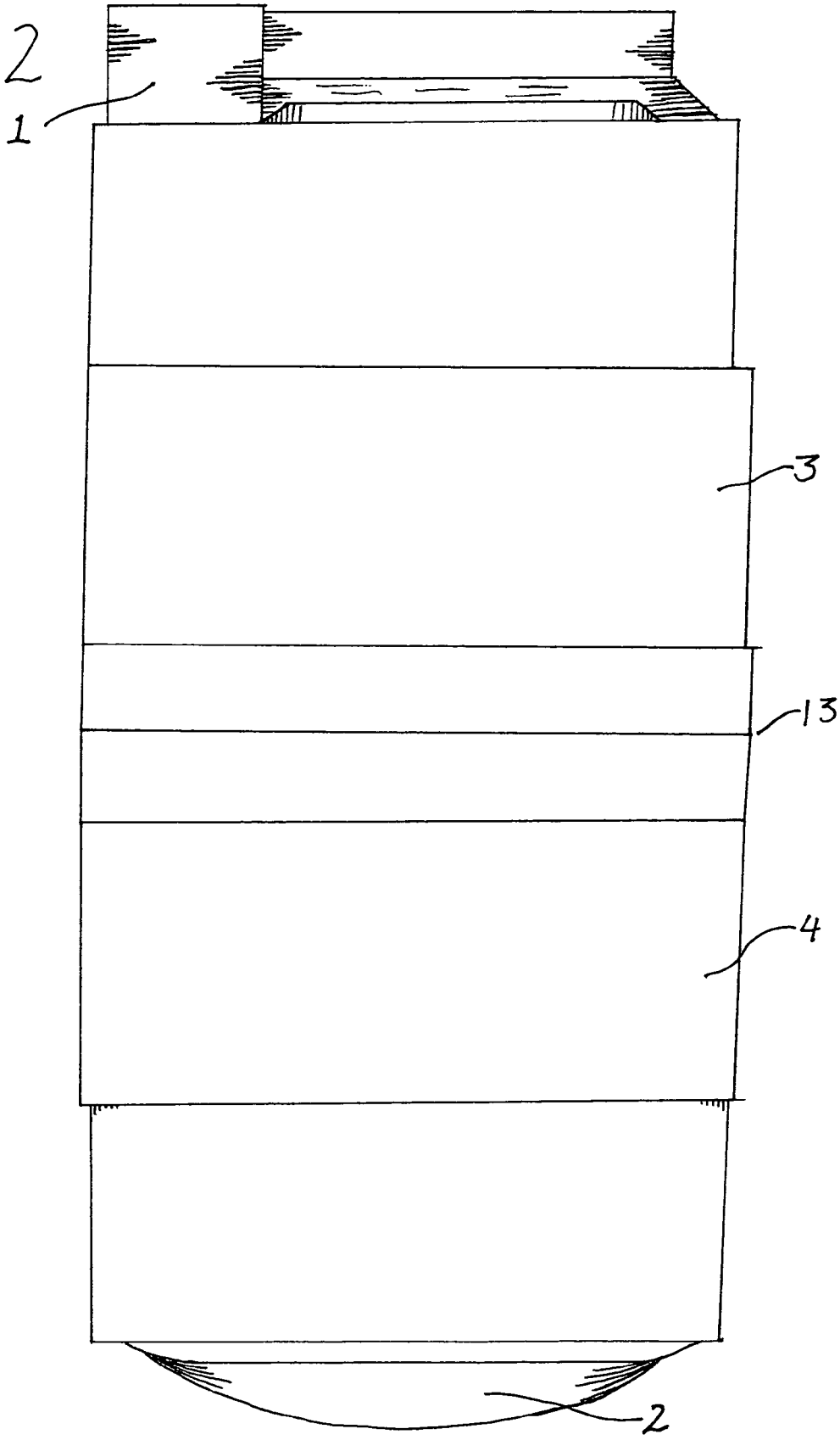
FIG. 2 illustrates the invention cartridge in frontal view.

Referring to FIG. 2, FIG. 3 and Table I; The Length (14) is from 11.67 inches (296.4 mm) plus 0.125 inches (3.175 mm) and minus 0.5 inches(12.7 mm). The diameters (15) and (16) 5.57 inches (141.5 mm) plus 0.125 inches (3.175 mm) and minus 0.5 inches(12.7 mm). The inlet (1) ID is 1.21 inches plus or minus 0.05 inches (1.3 mm). The outlet ID is 1.90 inches (30.7 mm) plus or minus 0.05 inches (1.3 mm).

Referring to FIG. 4, the radius (11) is preferably 0.45 inches (11.4 mm) plus or minus 0.05 inches (1.3 mm). Radius (10) is preferably 0.1 inches (2.54 mm) plus or minus 0.025 inches (0.6 mm).

Referring to FIGS. 3 and 4, the preferred embodiment includes at least a single ply filter media in the fan-folded filter (5) and at least 25 pleats and as many as 55 pleats. The depth of each pleat is at least 0.75 inch (19.05 mm) and can be as much as 1.75 inches (44.5 mm). Said filter has at least a 0.5 micron filter media, HEPA (0.3 micron), or ULPA (0.12 micron) filtration efficiency.

TABLE I

| Item | Reference # | Dimension, Inches | Plus inches | Minus inches |
|---|---|---|---|---|
| Inlet | 1 | 1.21 | 0.05 | 0.05 |
| Outlet | 2 | 1.90 | 0.05 | 0.05 |
| Radius 10 | 10 | 0.10 | 0.025 | 0.025 |
| Radius 11 | 11 | 0.45 | 0.05 | 0.05 |

TABLE I-continued

| Item | Reference # | Dimension, Inches | Plus inches | Minus inches |
|---|---|---|---|---|
| Length | 14 | 11.67 | 0.125 | 0.5 |
| Width 15 | 15 | 5.57 | 0.125 | 0.5 |
| Width 16 | 16 | 5.57 | 0.125 | 0.5 |
| Inlet end | 17 | 4.45 | 0.125 | 0.5 |
| Outlet end | 18 | 4.45 | 0.125 | 0.5 |

What is claimed is:

1. A vacuum cleaner filter cartridge for a vacuum cleaning machine, comprising:

a cartridge body having an inlet and an outlet;

a first fan folded, single ply or multi layered filter for filtering air disposed therein between the said inlet and outlet portions of the cartridge body;

a pair of shells forming said cartridge and holding the fan-folded said filter paper;

said cartridge having a top cover shell which receives the inlet aperture;

said cartridge having a lower cover shell which contains the outlet aperture;

said top shell and said lower shell being generally square in cross section with two adjacent large radius corners and two adjacent small radius corners.

2. A filter cartridge as in claim 1, wherein said cartridge has an outside length dimension of less than 11.80 inches (300 mm) and greater than 11.17 inches (284 mm).

3. A filter cartridge as in claim 1, wherein said cartridge has an outside width dimensions of less than 5.70 inches (145 mm) and greater than 5.07 inches (128 mm).

4. A filter cartridge as in claim 1, where two adjacent, longitudinal radii are less than 0.50 inches (12.7 mm) and greater than 0.40 inches (10.2 mm).

5. A filter cartridge as in claim 1, wherein two said adjacent, longitudinal radii are less than 0.125 inches (3.2 mm) and greater than 0.075 inches (1.9 mm).

6. A filter cartridge as in claim 1, wherein an inside diameter of said inlet is less than 1.26 inches (32 mm) and greater than 1.16 inches (29.5 mm).

7. A filter cartridge as in claim 1, wherein an inside diameter of said outlet is less than 1.95 inches (49.5 mm) and greater than 1.85 inches (47 mm).

8. A filter cartridge as in claim 1 wherein said filter is rated as a HEPA filter.

9. A filter cartridge as in claim 1 wherein said filter is rated as an ULPA filter.

10. A filter cartridge as in claim 1 wherein said fan folded filter includes at least 25 pleats.

11. A filter cartridge as in claim 1 wherein said fan folded filter contains pleats at least 0.75 inches (19.05 mm) in depth.

12. A vacuum cleaner filter cartridge for a vacuum cleaning machine, comprising:

a cartridge body having an inlet and an outlet;

at least a single layered fan folded filter for filtering air disposed therein between the said inlet and outlet portions of the cartridge body;

a pair of shells forming said cartridge and holding the fan-folded filter;

said cartridge having a top cover shell which receives the inlet aperture;

said cartridge having a lower cover shell which contains the outlet aperture;

said cartridge having an outside length dimension less than 11.80 inches (300 mm) and greater than 11.17 inches (284 mm);

said cartridge having an outside width dimensions less than 5.70 inches (145 mm) and greater than 5.07 inches (128 mm);

said cartridge having two adjacent, longitudinal radii less than 0.50 inches (12.7 mm) and greater than 0.40 inches (10.2 mm);

said cartridge having two adjacent, longitudinal radii less than 0.125 inches (3.2 mm) and greater than 0.075 inches (1.9 mm).

13. A filter cartridge for a vacuum cleaning machine, comprising:

a cartridge body having an inlet and an outlet;

at least a single layered fan folded filter for filtering air disposed therein between the said inlet and outlet portions of the cartridge body;

a pair of shells forming said cartridge and holding the fan-folded filter;

said cartridge having a top cover shell which receives the inlet aperture;

said cartridge having a lower cover shell which contains the outlet aperture;

said cartridge having an outside length dimension less than 11.80 inches (300 mm) and greater than 11.17 inches (284 mm);

said cartridge having an outside width dimensions less than 5.70 inches (145 mm) and greater than 5.07 inches (128 mm);

said cartridge having two adjacent, longitudinal radii less than 0.50 inches (12.7 mm) and greater than 0.40 inches (10.2 mm);

said cartridge having two adjacent, longitudinal radii less than 0.125 inches (3.2 mm) and greater than 0.075 inches (1.9 mm), where the said vacuum cleaning machines are selected from the group consisting of;

a) Atrix International, Inc.: OMEGA®, OMEGA® Supreme, ULTIVAC®, ULTIVAC® DLX, MENDA® Vac b) The 3M field Corporation: service vacuum cleaners models 497AJ, 497AB, 497AJH, 497ABD, 497AJK, 497AJM c) LaserVac, an Eltrex Company: The SHARK 9000 SERIES II®.

* * * * *